United States Patent [19]

Stahl et al.

[11] 4,150,753

[45] Apr. 24, 1979

[54] MERCHANDISE DISPLAY FIXTURE

[75] Inventors: Charles J. Stahl, Butler; Bruce L. Armstrong; David M. Moore, both of Pittsburgh, all of Pa.

[73] Assignee: Armstrong Store Fixture Corporation, Pittsburgh, Pa.

[21] Appl. No.: 893,773

[22] Filed: Apr. 5, 1978

[51] Int. Cl.[2] ..... A47H 1/02

[52] U.S. Cl. ..... 211/105.1; 248/251

[58] Field of Search ..... 211/123, 124, 204, 206, 211/105.1, 105.3; 248/251, 257, 258, 265, 263, 256, 266, 269, 270; 403/346, 347, 361

[56] References Cited

U.S. PATENT DOCUMENTS

| | | | |
|---|---|---|---|
| 1,407,251 | 2/1922 | Byron | 248/263 |
| 2,317,893 | 4/1943 | Martino | 211/105.3 |
| 3,285,668 | 11/1966 | Fearon | 403/361 |
| 3,685,662 | 8/1972 | Varon | 211/105.1 |

*Primary Examiner*—J. Franklin Foss

*Attorney, Agent, or Firm*—Parmelee, Miller, Welsh & Kratz

[57] ABSTRACT

A merchandise display fixture of the type wherein a horizontal bar is supported between two or more spaced brackets extending forwardly from a supporting column which has its outer end bent to a generally U-shaped contour. The two leg portions of the U each have a vertical slot therein, these being directly opposite each other and are of a shape and dimension designed to snugly receive the horizontal bar to be supported. The base portion of the U-shaped end of the bracket has a cam element thereon arranged to bear against the outer face of the horizontal bar as it is forced downwardly into the opposed vertical slots and spring the edges of the slot into tight binding contact with the horizontal bar, holding it against longitudinal movement and requiring force to lift it from the slots.

6 Claims, 6 Drawing Figures

MERCHANDISE DISPLAY FIXTURE

This invention is for a merchandise display assembly of the type in which a horizontal bar is supported at or near its ends in brackets extending forwardly from fixed uprights, the horizontal bar is turn frequently, but not necessarily, having a series of rod-like merchandise holding hooks therealong to receive plastic merchandise-containing envelopes having an eyelet at the top for hanging the envelopes from said hooks, but the present invention is not in any way restricted to such use or purpose.

Merchandise display fixtures of this type enable a merchant to arrange, alter, and relocate merchandise to whatever kind for which they are used to suit the location, arrangement and kind of merchandise and adapt to the allotted space or prominence of the display area as the merchant may select without custom-building display furniture to meet the purpose. Being of an adaptable and flexible nature, careless on inattentive customers may sometimes accidentally, or even purposely, remove or dislocate the horizontal bar from its supports.

The present invention provides a display fixture having the required flexibility but which is more secure against displacement, even accidental or on purpose, while being less expensive to use than fixtures heretofore provided for this purpose, and equally convenient.

According to the present invention, there is provided a horizontally extending bracket having an inner terminal portion with spaced hooks for securing the bracket in the spaced openings of a vertical column in a manner well known in the art. The outer end of the bracket is angularly turned with respect to the length of the horizontal bracket and this angularly turned portion then preferably has a reversely turned terminal wing extending toward the inner end of the bracket. There is a vertical slot or opening in the forwardly extending portion of the bracket of a shape and size to snugly receive the one end of a crossbar, which the bracket is designed to receive and support, and the reversely turned wing desirably has a similar opening or at least a vertical edge arranged also to receive or exert pressure against the bar in a manner to frictionally restrain the bar when it is inserted in the bracket against endwise movement or free vertical removal from the bracket. This binding of the bar is achieved by the arrangement of what I term an interference plug or cam member tending to exert a biasing force or pressure against a contacting face or faces of the bar.

The invention may be more fully understood by reference to the accompanying drawings illustrating two forms of a preferred embodiment of my invention, one of which shows a bracket for use with a solid bar of rectangular section and the other of which shows the structure designed for use with a square bar. In the drawings.

Figure 1:
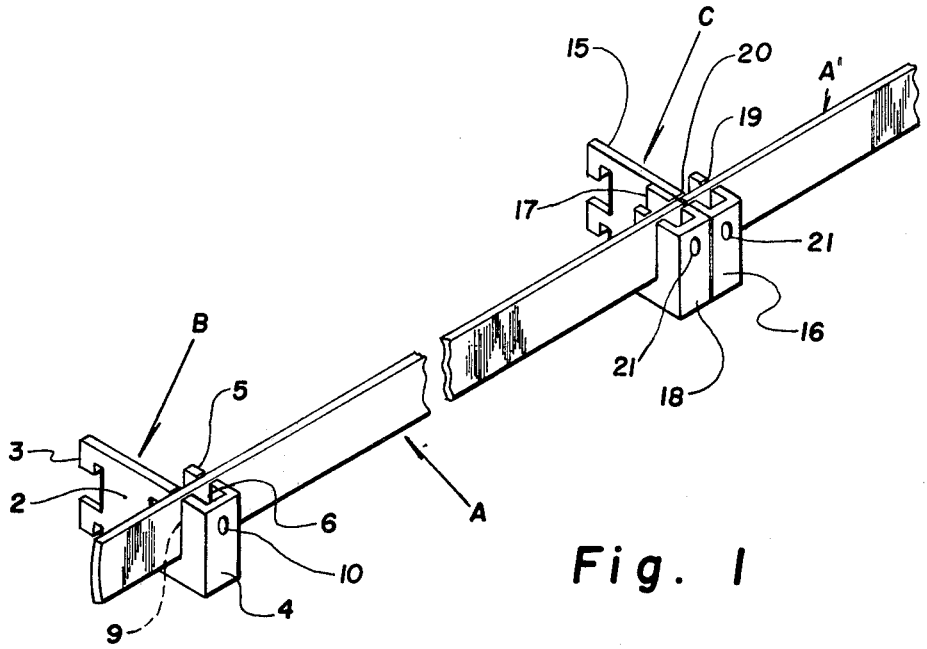
FIG. 1 is a perspective view of an assembly wherein there are two brackets, one for supporting the end of a single bar and one for supporting the opposite ends of two separate bars.
Figure 2:
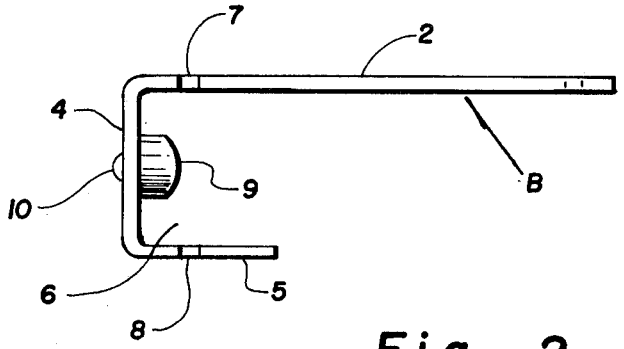
FIG. 2 is a plan view of the end supporting fixture shown in FIG. 1.
Figure 3:
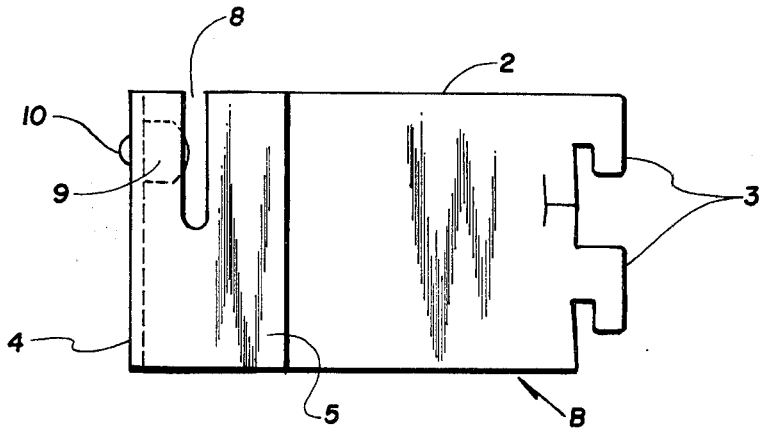
FIG. 3 is a side elevation of FIG. 2 as viewed from the inner side face of the bracket.

Referring first to FIGS. 1 to 3 inclusive, A designates the support bar, B is a left end bracket for the bar, and C is a center bracket. A right end clip is not shown, but the outer terminal would be merely reversed with respect to B, for which reason it has not been shown. The bar A is a conventional flat bar turned edgewise so that its wide flat sides intermediate the top and bottom edges of the bar are vertical.

As above stated, the end bracket B is for the left end for the support of bar A. It is formed of flat sheet or strip metal, the wide side faces of which, in use, are vertical. It has a forwardly extending arm portion 2 with hooks 3 at its inner end designed to be engaged in the spaced slots of an upright vertical column, not shown, but which usually is of a channel section commonly used in store fixtures. The outer end of the bracket has an angularly turned outer terminal portion 4 at the free edge of which is an inwardly or reversely turned flange or wing 5 that provides, in effect, a vertical U-shaped or channel like recess 6, one side of which is provided by the outer end portion of the bracket and the other by the wing 5, while the portion 4 constitutes the web of the channel or base of the U.

The two sides of the U-shaped configuration constituting the outer terminal portion of the bracket are provided with confronting slots 7, in the outer end portion of the bracket, and 8 in the wing or reversely turned terminal portion 5. These slots are of the same size and are shaped to conform to the shape of and snugly receive the end portion of the crossbar A with the confronting edges of the openings or slots being spaced to provide vertical edges parallel with the flat side of the crossbar A.

In the web portion 4 of the channel there is fixed an interference plug or cam body 9 having a metal shank 10 riveted, threaded, or otherwise fixed in an opening through the web of the channel, and the body 9 is formed of plastic or metal fixed to the shank within the channel portion of the terminal and with its end face slightly convex and protruding slightly at a level beginning below the top of the slot to more freely admit the lower edge of the crossbar when it is being inserted in the opening by downward pressure transverse to the length of the crossbar occupied by the portion of the crossbar which is entered in the confronting slots or openings 7 and 8.

The cam or interference plug 9 requires force to be exerted in pressing the bar A down into the openings or slots 7 and 8 and, in so doing, presses the opposite flat face of the bar into binding and gripping contact with the vertical inner edges of the respective slots or openings 7 and 8.

As shown in FIG. 1, the wing portion 5 is positioned and spaced from the right side of the longitudinal axis of the bracket. The similar bracket, not shown, for the right end of the bar would have the wing 5 to the left of the longitudinal axis of the bracket, but is not otherwise different.

Where two support bars are to be positioned at the same level in end-to-end relation, the bracket C may be used in place of a right and left pair brackets. It comprises a bracket member 15 of the same shape and construction as the left bracket above-described, with a generally U-shaped outer terminal portion 16 integral with the bracket, this U-shaped terminal being here shown as being at the right side of the longitudinal axis of the bracket as previously described. There is a right end terminal piece 17 welded to the left side face of the bracket 15. It has a channel portion 18 similar to the terminal portion 16 but reversed with respect thereto. There are slots 19 and 20 in each of these terminals similar to the slots 7 and 8, respectively, of FIGS. 1 to 3. There are interference plugs, not shown, but similar to the plugs 9 of FIGS. 2 and 3 in each of the two U-shaped terminal portions 16 and 18, the circles 21 indicating the outer ends of the metal shanks of said plugs.

FIG. 1 shows the crossbar A having its right end received in the terminal piece 17 of the center bracket, thereby showing a bar completely supported at both ends. A similar bar A′ has its left end entered in the terminal portion 16 of the center bracket to indicate how bars may be supported in end to end relation.

Figure 4:
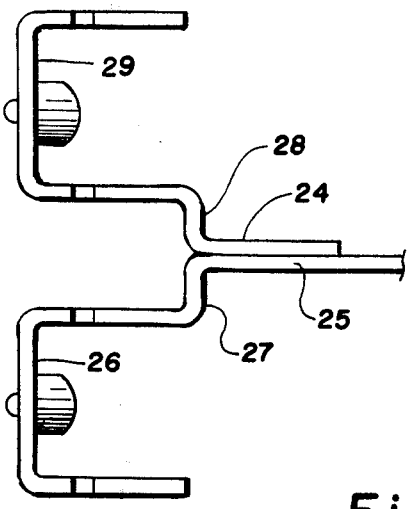
FIG. 4 is a plan view of an alternate center bracket.

FIG. 4 shows an alternate form of center bracket to that shown in FIG. 1, except that the integral bracket arm 25 has one U-shaped terminal portion 26 offset at 27 to one side of the vertical plane or the longitudinal axis of the bracket, and the piece 24 wleded to the other side face of the bracket has an offset of 28 so that its U-shaped terminal portion 29 is offset to the same extent as 27 but to the opposite side of the plane of the bracket, thereby providing better clearance between the confronting ends of the two bars, with each bar end being free to extend fully through the two opposed slots in a U-shaped outer end terminal portion of the bracket.

Figure 5:
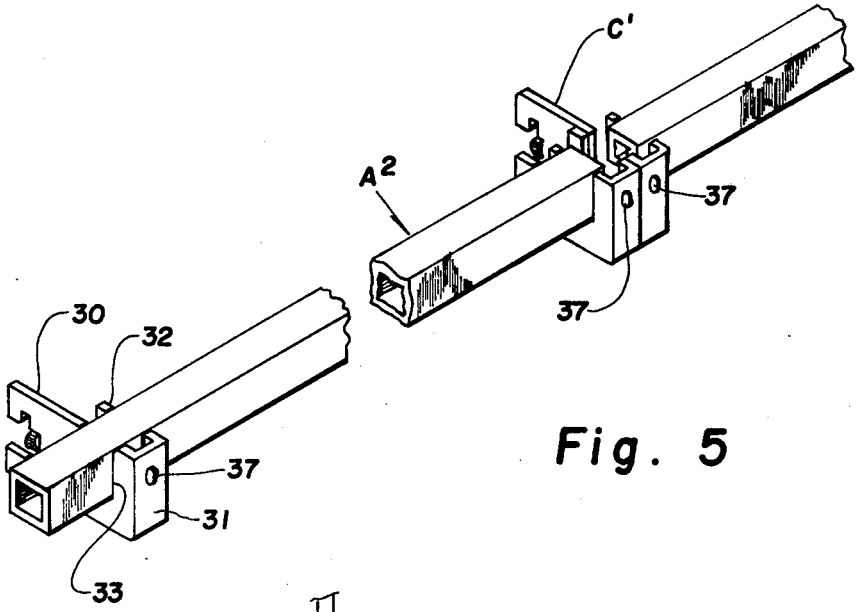
FIG. 5 is the counterpart of FIG. 1, but the bracket here shown is designed for use with a bar square section, and with a slightly modified form of interference plug.

FIG. 5 shows a bracket similar to that shown in FIGS. 1 to 3 with a forwardly extending horizontal arm 30 having mounting hooks at its inner end and the outer terminal has a U-shaped contour with the forward portion of the horizontal arm forming one leg of the U, the transversely bent end wall 31 being the web of the U, and the reversely turned wing portion 32 being the other leg of the U. However, in this case the bar $A^2$ is a hollow square section so that, instead of the two legs of the U-shaped terminal having opposed narrow slots therein, the outer end of the bracket comprising one leg of the U-shaped terminal portion, as in FIGS. 1 to 3, has a wide recess slot or opening 33 of a depth and width to snugly receive the end of the square bar $A^2$. The wing 32 has a similar cut-out or opening 35 therein also of a depth and width to snugly fit the square bar $A^2$, and this cut-out is to one side of but opposite opposite and in line with the opening 33.

Figure 6:
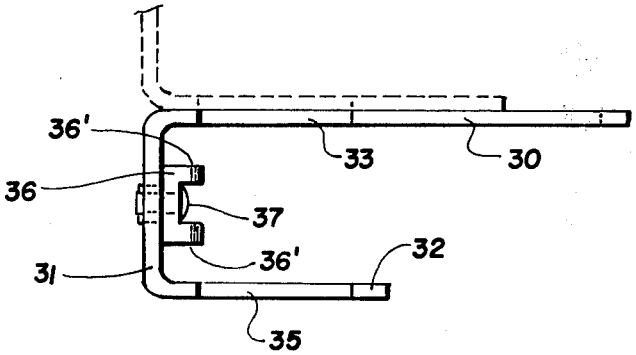
FIG. 6 is a plan view of FIG. 5, but on a larger scale.

There is an interference plug 36 secured to the web 31 of the terminal which has an opening into which the shank of fastener 37 is screwed, riveted or otherwise fixed. The interference plug 36 itself is shown as a modified form of 9 in FIGS. 1 to 4 and has parallel ribs 36′ at each side of the fastener 37 which extend downwardly along the plug. They are rounded or beveled at their upper ends, below the top opening but as seen in FIG. 6, they provide a convex surface in a vertical direction which project slightly into the path of the bar $A^2$ as it is pushed down into opposed wide notches or spaces 33 and 35 to be tightly wedged into these notches and force its opposite flat face into binding engagement with the vertical edges of the recesses against which they are forced.

A bracket, not shown, for the other end of the bar is the same except reversed so that the U-shaped terminal for the right end of the bar would be to the left of the plane of the bracket instead of to the right. A center bracket C′ would have dual bar end holding elements or terminal portions, as in FIGS. 1 or 4, only with the bar receiving notches being wide, and would have interference plugs or cams, as hereinbefore described.

Basically, therefore, the bracket has a bar receiving terminal portion with a cam surface positioned to bear against the flat side face of a bar entered into the terminal and exert pressure against the bar transverse to its length and against vertical edges of a notch or notches bearing against the opposite face of the bar to firmly hold the bar against relative movement in the direction of its length or upwardly in a direction transverse to the length of the bar.

I claim:

1. A merchandise supporting and display fixture having a horizontal bar extending between and supported by spaced brackets, the bar being of a noncircular transverse section with flat side faces between its top and bottom edges, the invention comprising a supporting bracket comprising:

a. a forwardly extending generally horizontal arm having an inner end portion for attaching it to a vertical supporting means and an outer end portion;

b. said outer end portion having a terminal web extending transversely to the arm and with a reverse wing portion thereon turned toward the inner end of the arm;

c. the arm having an opening therethrough transverse to the vertical plane of the arm spaced inwardly from said web, the top of said opening being open to receive the lower edge of the bar when said bar is entered in a direction transverse to its length downwardly into said opening and of a shape providing a sliding fit to receive the bar and with opposite side edges that are parallel with the flat side faces of the bar when it is so entered to the full depth of the opening; and d. a cam means on the bracket at a level below the top of the opening where it is arranged to resist the entrance of the bar only after the lower edge of the bar is first entered in the open top of said opening in the manner defined in paragraph (c) and thereafter yieldingly exert pressure transverse to the length of the bar against one of said flat side faces of the bar to urge the other flat face into firm contact with the opposite edge of the opening, and restrain the bar against rotational movement about its axis, said reversely turned wing providing a second edge against which a flat surface of the bar is also frictionally urged by said cam.

2. The bracket defined in claim 1 in which said vertical edge of the wing constitutes one side of an opening through the wing in a similar confronting spaced relation to the opening in the arm and the cam means is located to bear against the bar between the two openings.

3. The bracket defined in claim 2 wherein the cam means is mounted on the inner face of the terminal web portion of the bracket.

4. The bracket defined in claim 1 in which the outer terminal portion of the bracket is of a U-shape, one leg of which is the forward portion of the bracket and the other leg of which is the reversely turned wing, and the base of the U-shape is the transversely bent out end wall of the bracket, the spaced legs of the U-shaped terminal having confronting openings therethrough of a size and shape to receive the bar to be supported by the bracket, the cam being fixed to the web of the U-shaped terminal portion with an outer surface arranged to exert transverse pressure against the face of the bar entered in said openings and press the bar against the vertical edges of the said confronting openings.

5. A bar supporting bracket for supporting and firmly holding a load supporting bar of noncircular cross-section and which has flat side faces along its sides between its top and bottom edges, the bracket having a horizontally extending arm member having means at its inner end for attaching it to an upright support and having an outer terminal portion with a transversely extending end at the free edge of which is a reversely turned wing portion that extends toward the inner end of the bracket, the end of the bracket thereby being of a U-shape with one leg of the U being the forward end portion of the horizontally extending arm and the reversely turned wing comprising the other leg with the transversely extending leg constituting the base of the U-shape, the two said leg portions having confronting matched and aligned openings therethrough having open tops and which are of a shape and size to snugly receive the crossbar to be supported, and means for forcing a flat wall of a bar received in said openings into binding and non-rotatable engagement with a wall of the opening in said wing while also restraining the bar against rotation about its longitudinal axis.

6. In a merchandise supporting and display fixture having a flat-sided horizontal supporting bar and spaced supporting brackets for the bar, the invention comprising a bracket for such purpose having:

a. a forwardly extending horizontal arm with means at its inner end for attaching it to a support, b. an outer end portion having a terminal web extending sideways transversely to the length of the arm, c. the arm having an opening conforming substantially in size and shape to the transverse section of the crossbar therethrough near to but spaced inwardly from said terminal web portion into which the supporting bar may be inserted with a sliding fit by pushing it downwardly transversely of its length from above the opening, d. cam means on said terminal web portion arranged to yieldably resist such insertion of the support bar into the said opening while tending to spring said web portion outwardly to maintain a binding pressure between the opening in the arm and the support bar when it is received in the opening and restrain the bar against free endwise slippage in the bracket and with the edges of the opening being parallel with the flat sides of the bar so that the bar is confined by the sides of the opening against rotation about its axis while also being restrained against free slippage in the direction of the length of the bar.

* * * * *